United States Patent [19]

Rose

[11] 4,326,676

[45] Apr. 27, 1982

[54] RECIPROCATING INFEED TUBE FOR CENTRIFUGAL IMPACT ROCK CRUSHER

[75] Inventor: Neil M. Rose, Vancouver, Wash.

[73] Assignee: Canica Crushers, Ltd., Vancouver, Wash.

[21] Appl. No.: 148,824

[22] Filed: May 12, 1980

[51] Int. Cl.[3] ..... B02C 19/00

[52] U.S. Cl. ..... 241/275

[58] Field of Search ..... 241/275, 285 R

[56] References Cited

U.S. PATENT DOCUMENTS 3,873,047 3/1975 Johnson ..... 241/275

4,065,063 12/1977 Johnson ..... 241/275

4,090,673 5/1978 Ackers et al. ..... 241/275

*Primary Examiner*—James M. Meister

*Attorney, Agent, or Firm*—Chernoff & Vilhauer

[57] ABSTRACT

A centrifugal impact rock crusher having a centrally located rotary impeller table with a feed cone centrally located on it is equipped with a vertically reciprocating feed chute located above the feed cone. The mouth of the feed chute periodically moves downward to partially surround the feed cone to vertically distribute radial flow of material being crushed and thereby reduce concentration of impeller shoe and anvil face wear during crushing of uniformly sized gravel.

3 Claims, 2 Drawing Figures

RECIPROCATING INFEED TUBE FOR CENTRIFUGAL IMPACT ROCK CRUSHER

BACKGROUND OF THE INVENTION

The present invention relates to improvements in centrifugal impact rock crushers, and particularly to feed apparatus for use in such rock crushers to improve the pattern of abrasive wear on replaceable portions of the rock crushers in order to reduce the frequency of need for replacement of those parts.

Centrifugal impact rock crushers generally comprise a horizontal impeller table which rotates about a vertical axis, at a speed which is typically about 1400 RPM, while material to be crushed is fed downwardly onto the center of the impeller table. Impellers mounted on table direct the material radially outward as the centrifugal force created by the rotating table throws the material off of the impellers and against the faces of stationery anvils surrounding the table, where the impact shatters the material into smaller pieces. Since the dust and crushed rock created by the crushing operation is extremely abrasive, the impellers are equipped with replaceable elements called shoes, and the anvils and other portions of the rock crusher exposed to contact with the material being crushed are similarly equipped with replaceable faces or liners.

The impeller table typically includes a central feed cone which rotates with the table to distribute the material among the several impellers to evenly distribute wear of the impeller shoes and loading of the bearings which support the impeller table. When crushing pieces of rock of mixed sizes, the different sized pieces of material generally are thrown radially outward from the cone at different heights corresponding somewhat to the weight of each piece. That is, smaller pieces leave the cone at a higher location than do heavy pieces of rock. As a result, abrasive wear is fairly evenly distributed over the entire wearing surfaces of the impeller shoes, anvils, and other replaceable parts.

A serious problem, however, is presented when a centrifugal rock crusher of this type is used to crush gravel of a fairly uniform size into sand. Gravel or crushed stone which has been graded to contain only pieces of a fairly small variation of size, such as in the size range of $\frac{3}{8}$–$\frac{1}{2}$ inch maximum dimension of each piece, is suitable to be crushed into sand in this type of rock crusher. Crushing material of such a uniform size, however, results in concentrated wear of impeller shoes and anvil face surfaces, since the gravel is consistently being thrown outwardly from the feed cone at about the same height. With a large proportion of the material concentrated near one height relative to the impeller, wear is also concentrated on the surfaces of the impeller shoes and the adjacent anvils at that same height, causing development of a groove along the faces of the impeller shoes and anvils. Such grooves, once started, are self-generating, and eventually require early replacement of impeller shoes and anvil faces, while much of their surfaces are free of appreciable wear.

What is needed therefore is a centrifugal impact rock crusher in which the flow of material to be crushed is distributed over the entire surface of each impeller shoe and anvil face to evenly spread abrasive erosion of internal parts of the rock crusher while crushing material consisting largely of pieces of uniform size.

SUMMARY OF THE INVENTION

The above described need for a centrifugal impact crusher including a mechanism for evenly distributing the abrasive effects of the material being crushed over the impeller shoes, anvil faces, and other crusher parts normally exposed to abrasive material is satisfied in the present invention, in which a centrifugal impact rock crusher having a central material distributing feed cone located on a rotary impeller table includes a feed chute which reciprocates vertically to periodically restrict pieces of the material to be crushed within the mouth of the feed chute, thereby causing the material to be deposited lower on the feed cone than it would otherwise be in order to allow the material to be thrown radially outward along the lower portions of the impeller shoes, and in turn strike the lower portions of the corresponding anvils.

The reciprocating feed chute includes an open lower end or mouth which is small enough to extend downwardly between the inner ends of the several impellers, yet which is large enough to surround at least a portion of the feed cone on the impeller table. When the feed chute is in its uppermost position, material deposited from the chute is free to be projected radially away from the upper portion of the cone, but when the feed chute's mouth is in its lowermost position, material to be crushed is restricted so that it must flow outward at a lower height relative to the impeller shoes. The vertically reciprocating motion of the feed chute mouth thus distributes the abrasive effects of crushing uniform material over a greater portion of the impeller shoes, anvil faces, and other crusher components than was previously obtained.

It is therefore a primary objective of the present invention to provide an improved centrifugal impact rock crusher which can be used to crush pieces of material of uniform size into smaller pieces wherein the operating life of the replacable wear resistant parts is longer than would otherwise be achieved.

It is another important objective of the present invention to produce even patterns of wear on the impeller shoes and anvil faces of a centrifugal impact rock crusher while crushing substantially uniform pieces of rock over a long time.

It is yet another objective of the present invention to reduce the expense of operation of a centrifugal impact rock crusher by extending the useable life of the impeller shoes, anvil faces, and other internal parts of such a rock crusher which are normally subject to abrasion by rock being crushed.

It is a principal feature of the present invention that it provides a vertically oscillating feed chute for use in a centrifugal impact rock crusher to distribute material being crushed over a vertical range, thus distributing the abrasion effects of the material over a wider portion of rock crusher internal surfaces.

It is another important feature of the present invention that it provides a centrifugal impact rock crusher having a feed chute which periodically descends to surround a portion of the feed cone of the impeller table, restricting radial movement of the material being crushed.

It is a principal advantage of the present invention that it provides a mechanism for distributing the radial flow of material being crushed over a range of heights relative to the rotary impeller table, thus distributing abrasive wear of impeller shoes, anvil faces, and other surfaces more evenly than has previously been accomplished.

It is another important advantage of the present invention that it permits operation of such a centrifugal impact rock crusher over longer periods without the necessity of replacement of impeller shoes, anvil faces, and other internal surfaces subject to abrasion by the materials being crushed, thus reducing expenses of operating such a rock crusher below what was previously possible when crushing uniform sized gravel.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
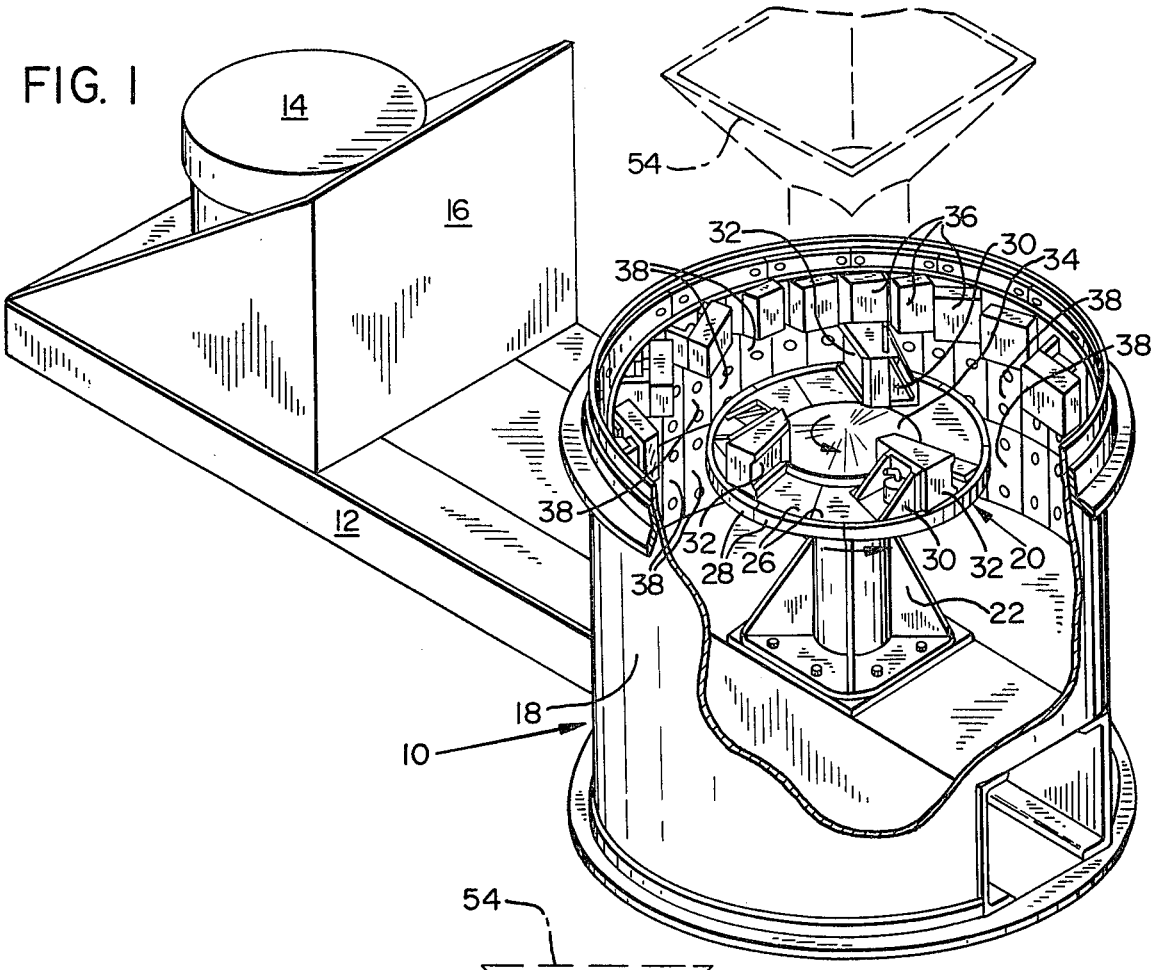
FIG. 1 is a partially cut away pictorial view of a centrifugal impact rock crusher of the type to which the present invention is applicable, with the cover of the rock crusher removed.

Referring now to the drawings, a centrifugal impact rock crusher 10, shown in FIG. 1, is seen to include a base 12, a drive motor 14, located behind a shield 16, and a generally cylindrical crusher housing 18. Located within the housing 18 is an impeller table 20, supported by a stand 22, having a generally horizontally oriented top, and arranged for rotation about a generally vertical axis of rotation, as it is rotated by a shaft 24 (FIG. 2) driven by the motor 14.

The impeller table 20 includes a plurality of replaceable top liners 26, rim liners 28, and impellers 30 having shoes 32 including generally vertically and radially extending forward faces. A material distribution feed cone 34 is located centrally on the impeller table 20 to receive material to be crushed and to distribute the material to the several impellers 30. Around the periphery of the housing 18 a plurality of replaceable anvil faces 36 are located in horizontal alignment with the impellers 30, and housing liners 38 are mounted on interal surfaces of the housing 18 below the anvils 36. A generally horizontally extending cover member 40 encloses the upper portion of the housing 18, and a feed chute 42 extends downwardly through an opening in the cover member 40. The feed chute 42 has a downwardly open mouth 44 at its lower end, and is supported, for example, by a support member 46.

The support member 46 is supported by a pair of links 48 connected to reciprocating apparatus 50 adapted to move the feed chute 42 reciprocally upward and downward as indicated by the arrows 52. The reciprocating apparatus 50 may, for example, consist of a cam and follower assembly, a crank assembly, or hydraulic piston and cylinder assembly, the only requirement being that it be capable of periodically raising and lowering the mouth 44 of the feed chute 42 through a range of motion approximately equal to the height of the impellers. The rate at which the feed chute is cycled somewhat effects the manner in which the material is distributed on the feed cone and it has been found that optimum distribution occurs at approximately 10–15 cycles per minute. An infeed hopper 54 is supported immovably in a position convenient for receiving material to be crushed by the rock crusher 10, with provision being made for the feed chute 42 to move relative to the infeed hopper without interference.

In operation of the rock crusher 10 according to the invention, material to be crushed is introduced into the infeed hopper 54, from which it flows downward as indicated by the arrow 56, encountering the feed cone 34 as it exits from the mouth of the feed chute 42. As the material comes into contact with the feed cone 34, which is rotating along with the entire impeller table at an exemplary speed of 1400 RPM, the pieces of material experience an angular acceleration tending to throw them radially outward into the path of rotation of an impeller 30, as indicated by the arrow 58. The horizontal level at which the material leaves the feed cone depends on the weight of the individual pieces of material and the speed at which the feed cone is rotating. Accordingly if the pieces of material are fairly uniform in size they are thrown off of the feed cone over a relatively narrow band.

Figure 2:
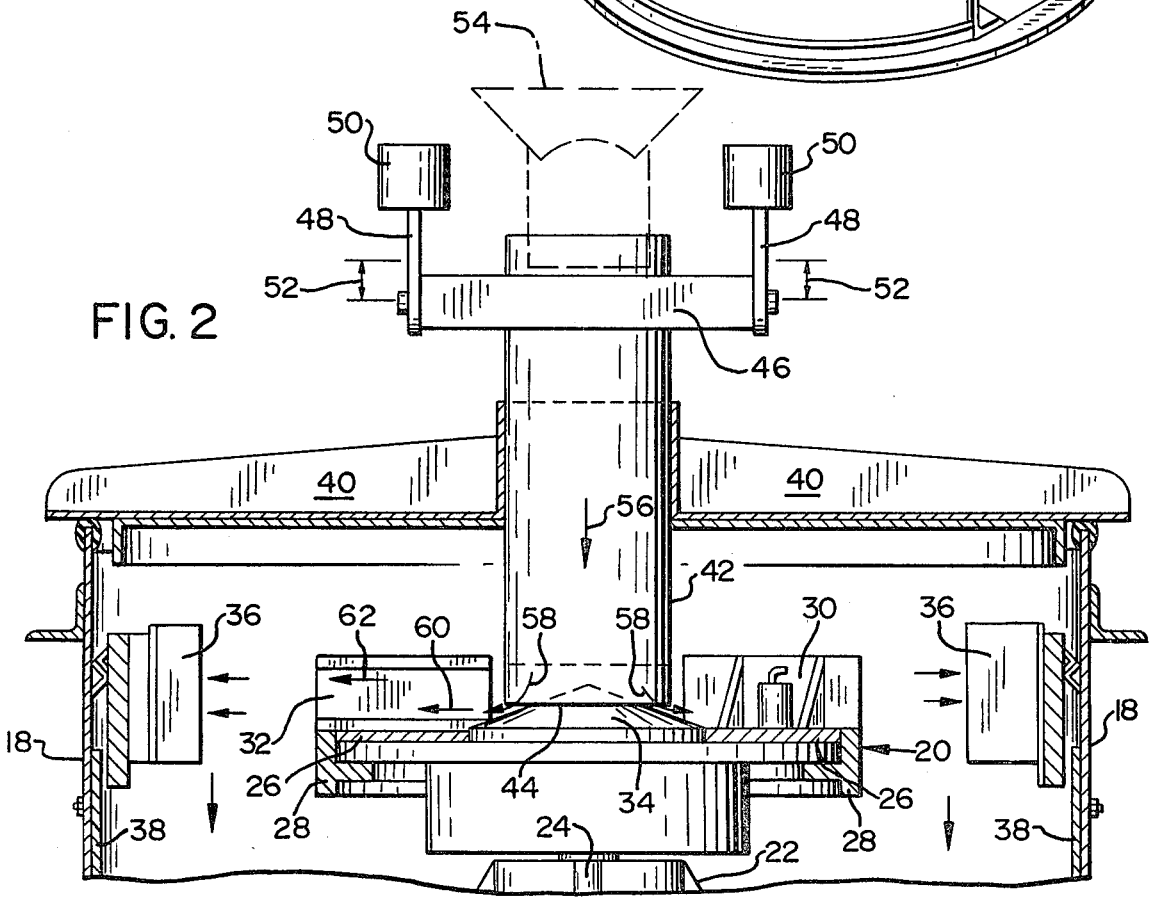
FIG. 2 is a fragmentary sectional view of the rock crusher shown in FIG. 1, equipped with a reciprocating feed chute embodying the present invention.

The mouth 44 of the chute 42, when in the position shown in FIG. 2, restricts movement of the material in a radially outward direction until the material has descended to the level indicated by the arrows 58, and thereby forces the material to a lower portion of the feed cone than it would otherwise strike so that the material proceeds along the lower portions of the impeller shoes 32, as indicated by arrow 60. As the reciprocating apparatus 50 lifts the feed chute 42 upward, raising the mouth 44 to the position indicated in broken line in FIG. 2, material being crushed in the normal manner is permitted to flow outwardly away from the feed cone 34 along the top portions of the impeller shoes 32, as indicated by the arrow 62. As the mouth 44 of the feed chute 42 reciprocates in this manner, the material being crushed is forced to move radially away from the feed cone at various heights, with resultant abrasion of the impeller shoe faces and the anvil faces against which the material is impelled also being distributed vertically, rather than concentrated at a single height determined by only the size of the individual pieces of material to be crushed. As a result, the rock crusher 10 may be used to crush a far greater amount of material of uniform size before replacement of impeller shoes, anvil faces, and liners is required by wear.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a centrifugal impact rock crusher of the type having an impeller table mounted for rotating about a generally vertical axis of rotation, a plurality of impellers located at angularly spaced intervals on the table and having faces extending above the table generally perpendicular thereto, a material distributing feed cone mounted centrally on the table, a feed chute located above the feed cone for distributing material to be crushed centrally onto the feed cone, and motor means for rotating the table and feed cone at a predetermined speed so that material deposited onto the feed cone is thrown radially outwardly from the feed cone intermediate the vertical extent of the impeller faces, the improvement comprising reciprocating means associated with said feed chute for cyclically raising and lowering the mouth thereof relative to said material feed cone.

2. The rock crusher of claim 1 wherein said feed chute is oriented so that said mouth moves between an upper position above the apex of said feed cone, and a lower position below the apex of said feed cone so that flow of material from said feed chute is partially restricted by said feed cone.

3. The rock crusher of claim 1 where said reciprocating means raise and lower said feed tube at 10–15 cycles per minute.

* * * * *